United States Patent [19]

Ken

[11] Patent Number: 4,991,155

[45] Date of Patent: Feb. 5, 1991

[54] TIMER

[75] Inventor: Ueda Ken, Soraku, Japan

[73] Assignee: Sharp Corporation, Osaka, Japan

[21] Appl. No.: 495,891

[22] Filed: Mar. 19, 1990

[30] Foreign Application Priority Data

Mar. 20, 1989 [JP] Japan ..... 1-31657[U]

[51] Int. Cl.[5] ..... H01H 7/08; G04F 8/00

[52] U.S. Cl. ..... 368/107; 200/38 FA

[58] Field of Search ..... 368/107–109; 200/36, 38 R, 38 A, 38 F, 38 FB, 38 B; 219/10.55 B, 492, 493

[56] References Cited

U.S. PATENT DOCUMENTS 3,737,595 6/1973 Simmons et al. ..... 200/38 A
3,879,587 4/1975 Draghi ..... 200/38 A
4,025,739 5/1977 Kull ..... 200/38 F
4,419,548 12/1983 Hales ..... 200/38 R
4,849,595 7/1989 Fowler ..... 219/10.55 B

*Primary Examiner*—Vit W. Miska
*Attorney, Agent, or Firm*—David G. Conlin; Robert F. O'Connell

[57] ABSTRACT

A timer comprising a time body which has an operating shaft capable of angularly rotating around an axis thereof from an original position, and outputs a continuous electrical signal only for a period of time during which the operating shaft returns from a desired angular position to the original position after the operating shaft has been rotated from the original position to the desired angular position, a knob provided at one end of the operating shaft, a push button capable of being pressed to a predetermined distance, and driving device for rotating the operating shaft from the original position by an angle corresonding to a distance to which the push button is pressed.

5 Claims, 5 Drawing Sheets

FIG.7 (1)
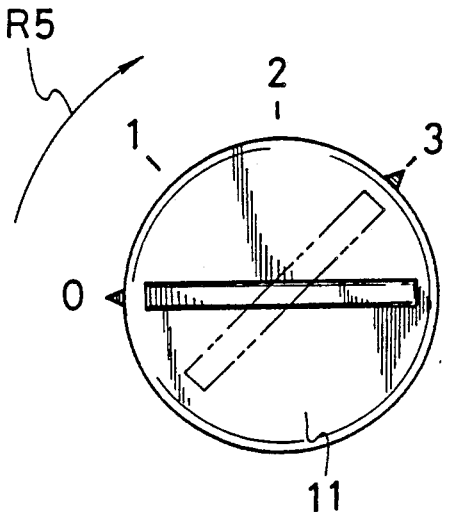
FIG.7 (2)
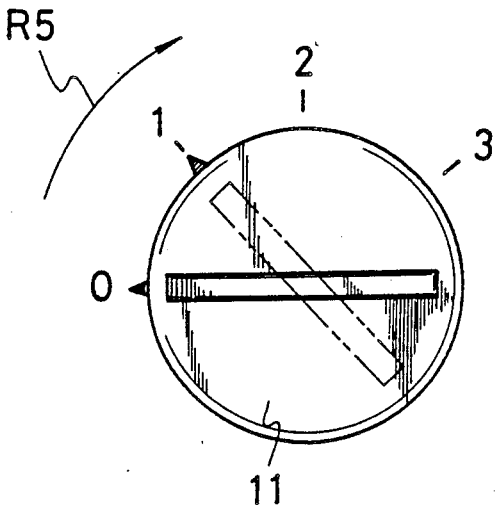
FIG.8
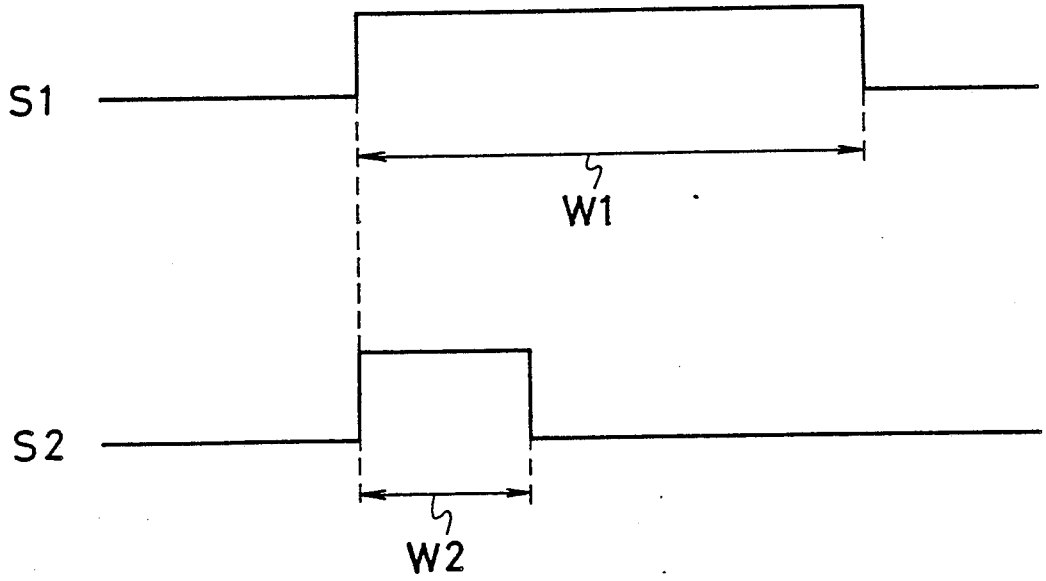

FIG.9 (1)
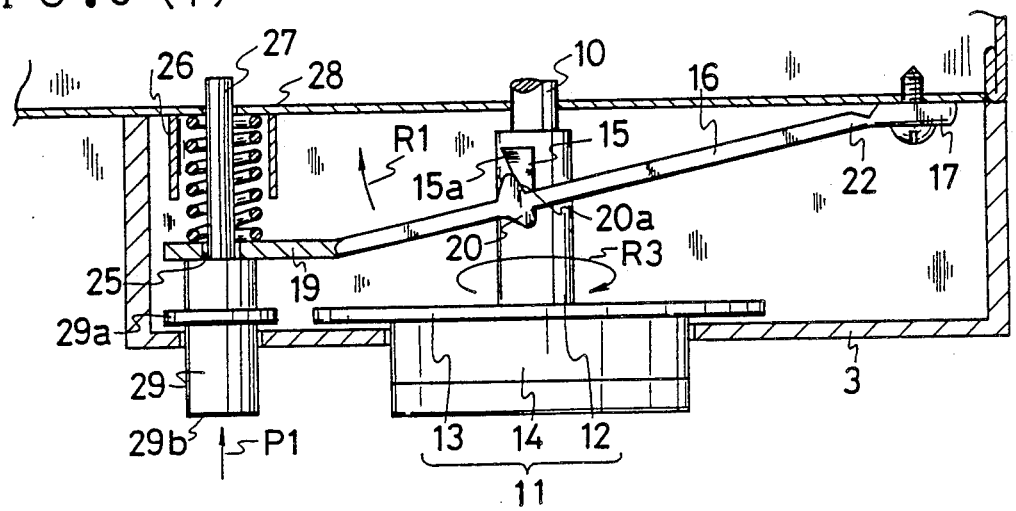
FIG.9 (2)
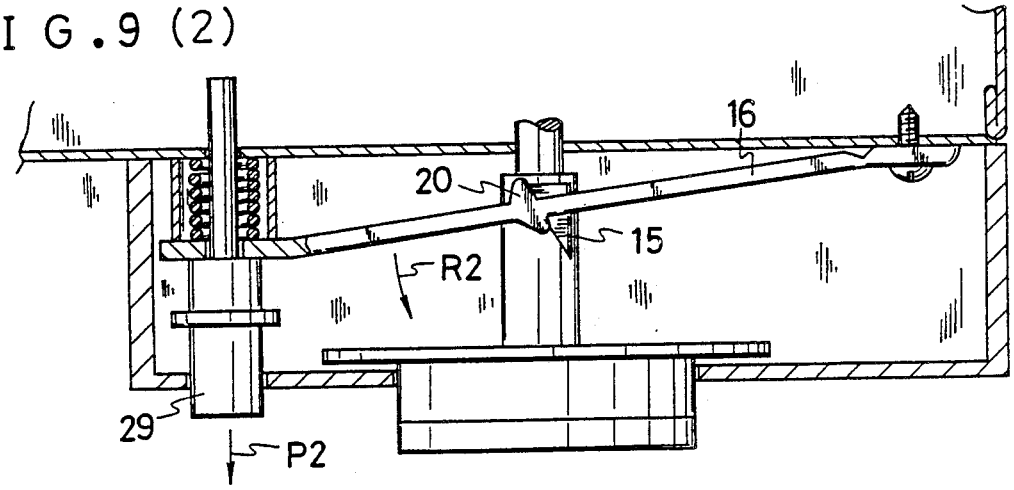
FIG.9 (3)
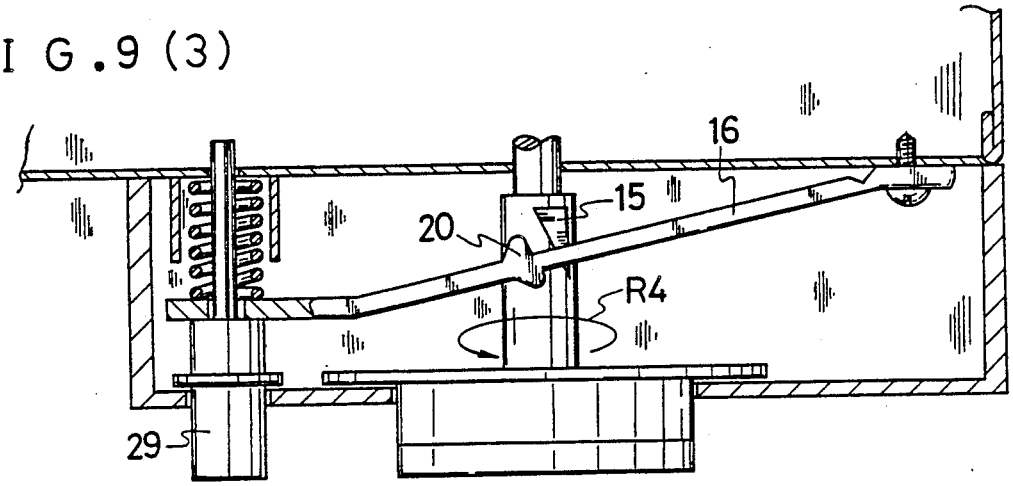

TIMER

BACKGROUND OF THE INVENTION

1. Field of the Invention

The present invention relates to a timer useful in a microwave oven, a toaster oven or the like for counting desired time of heat cooking.

2. Prior Art

Conventionally, a timer is provided in a microwave oven or the like, and food is heated by functioning heating means of the microwave oven for a predetermined time set by this timer, and when this predetermined time elapses, food heating stops automatically. In such a microwave oven, a heating time is required to be set in the timer every time heating is performed. For example, in a microwave oven having a high-frequency output of approximately 500 W, a heating time of approximately one minute is most frequently used. Accordingly, to simplify the setting operation of heating time, microwave ovens have also been conventionally realized wherein, separately from a mechanical timer, there is provided a so-called electronic one-minute timer or the like having a charge/discharge circuit composed of a resistor, a condenser, a comparator and the like, for distinguishing a level of the output thereof and performing a time counting operation.

Also, a microwave oven having a timer constituted by combining a rotary switch and a microprocessor is known (U.S. Pat. No. 4,849,595).

However, as described above, separate provision of such an electronic timer for the heating time frequently set often raises the price of the microwave oven unduly.

SUMMARY OF THE INVENTION

The present invention provides a timer comprising a timer body which has an operating shaft capable of angularly rotating around the axis thereof from an original position, and outputs a continuous electrical signal only for a period of time during which the operating shaft returns from a desired angular position to the original position after the operating shaft has been rotated from the original position to the desired angular position, a knob provided at one end of the operating shaft, a push button capable of being pressed to a predetermined distance, and driving means for rotating the operating shaft from the original position by an angle corresponding to a distance to which the push button is pressed.

Accordingly, in accordance with the present invention, there is provided a timer capable of counting a predetermined duration of time by a comparatively simple structure and simple operation.

BRIEF DESCRIPTION OF THE DRAWINGS

FIG. 5 (2) is a view showing a mechanism of outputting an electrical signal in a timer body.

FIGS. 7 (1) and (2) are views showing a knob 11 in operation.

FIG. 8 is a waveform graph showing an electrical signal outputted from the timer body 7.

FIGS. 9 (1), (2), and (3) are views for explaining operation of a timer 1.

DETAILED DESCRIPTION OF PREFERRED EMBODIMENT

In a timer of the present invention, a timer body has an operating shaft on which a knob is provided. When this knob is rotated around the axis of the operating shaft by a desired angle, the operating shaft returns in the reverse direction for a period corresponding to the rotation angle. The timer body continuously outputs an electrical signal for the period during which the operating shaft rotating to return. Counting of a desired period can be performed based on this electrical signal.

Furthermore, the timer of the present invention is provided with a push button and a driving means interlocked with the push button. When the push button is pressed, the driving means rotates the operating shaft by a predetermined angle in the direction of manually rotating operation correspondingly to a pressed distance of the push button. Accordingly, by a pressing the push button, the continuous electrical signal can also be outputted from the timer body for a period during which the operating shaft having rotated by the above-mentioned angle returns in the reverse direction, therefore, the counting operation for the period corresponding to the angle can be performed.

Figure 1:
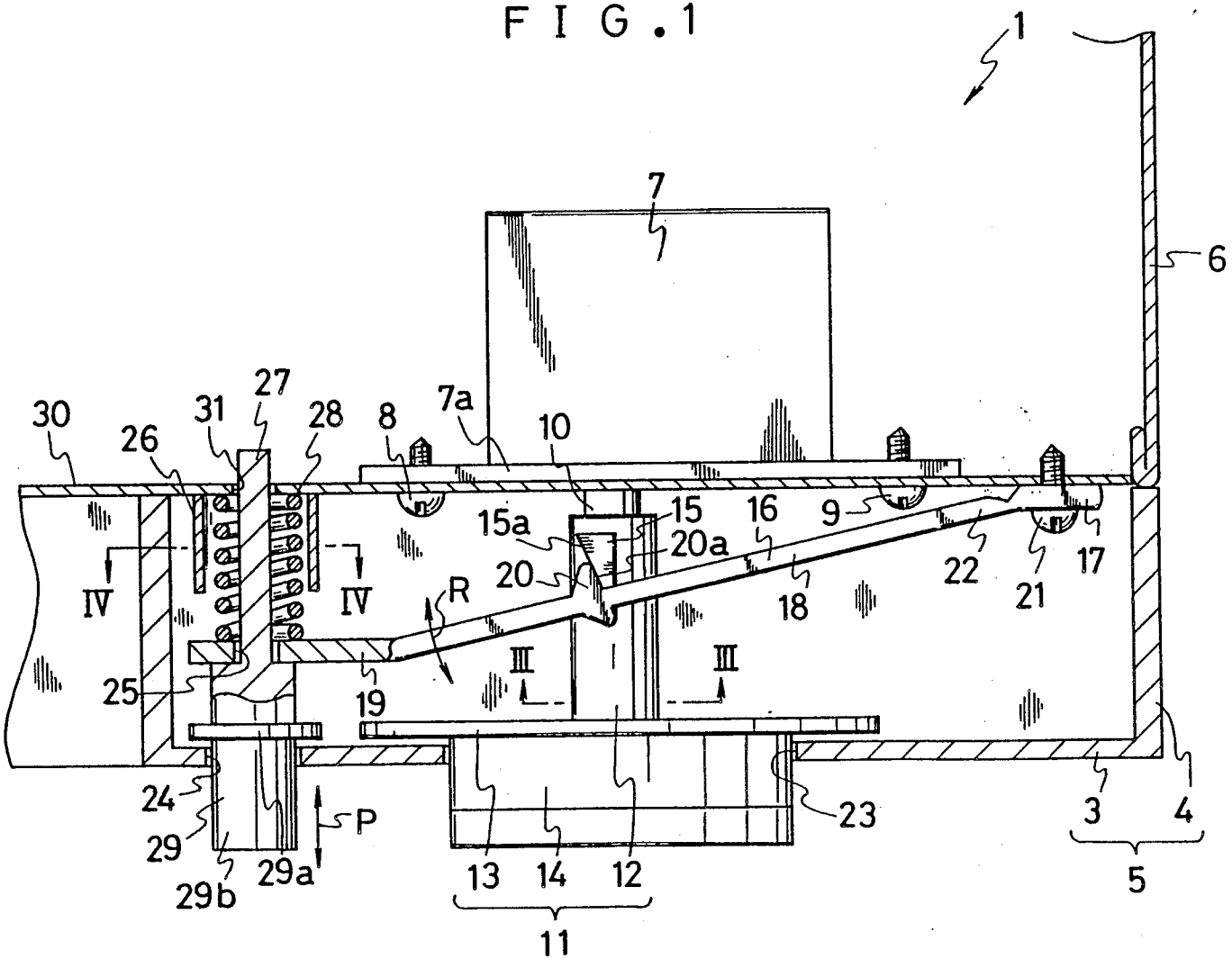
FIG. 1 is a section of an embodiment of the present invention.
Figure 2:
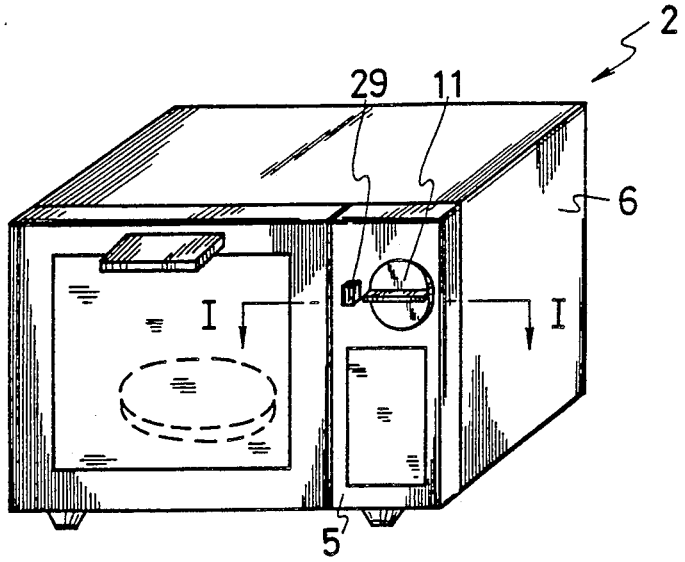
FIG. 2 is a perspective view of a microwave oven using the embodiment of the present invention.

FIG. 1 is a cross section of a timer 1 being an embodiment of the present invention. FIG. 2 is a perspective view of a microwave oven 2 provided with the timer 1. Particularly, FIG. 1 is a cross section of the timer 1 taken along line I—I of FIG. 2. The microwave oven 2 heats food by utilizing dielectric heating. That is, a high-frequency electric field generated by a magnetron (not illustrated) of the microwave oven 2 is applied to the food put there into, and thus the food is heated. A cover 5 is attached to the front of the microwave oven 2, and a knob 11 and a push button 29 of the timer 1 are provided in the cover 5 and projected therefrom.

The cover 5 has a front panel 3 and a side wall 4 which is fixed to a frame 6 of the microwave oven 2. A flange 7*a* of a timer body 7 is fixed to a mounting member 30 of the frame 6 by screws 8 and 9 on the side opposite to the front panel 3. An operating shaft 10 of the timer body 7 extends through the mounting member 30 toward the front panel 3 side, and the knob 11 is fixed to this operating shaft 10. The knob 11 comprises a stem portion 12 attached to the operating shaft 10, a flange 13 abutting the inner surface of the front panel 3 and a knob portion 14 extending through the front panel 3 and projecting therefrom. Also, a first protuberance 15 of substantially a triangular prism shape is formed at a predetermined position on the outer peripheral surface of the stem portion 12, and a second protuberance 20 of a driving lever 16 abuts this first protuberance 15.

The driving lever 16 has a mounting portion 17, a driving portion 18 and an interlocking portion 19. The mounting portion 17 is mounted on the mounting member 30 by a screw 21, and the driving lever 16 can be turned in the direction designated by an arrow R on a fulcrum 22 in the vicinity of the mounting portion 17.

A hole 25 is formed in the interlocking portion 19 of the driving lever 16, and a guide shaft 27 of the push button 29 extends through the hole 25 and a hole 31 formed in the mounting member 30 positioned opposite to the interlocking portion 19. Also, a compression spring 28 is fitted onto the guide shaft 27 between the mounting member 30 and the interlocking portion 19, and biasses the interlocking portion toward the front panel 3 side.

The interlocking portion 19 biassed by the compressing spring 28 abuts the push button 29, whereby a flange part 29*a* of the push button 29 abuts the inner surface of the front panel 3, and a press portion 29*b* projects outside from the front panel 3. By this arrangement, the push button 29 is depressed to a described position against the biassing force of the compression spring 28 by pressing the press portion 29*b*, and when the depression is released, it returns to the original position by the biassing force thereof. This means that the push button 29 reciprocates in the direction designated by an arrow P by pressing and releasing, and the driving lever 16 rotates in the direction designated by the arrow R in cooperation therewith.

A stopper 26 formed by cut-raising or the like is provided around the hole 31 of the mounting member 30. Thus, the rotation in angle of the driving lever 16 in the direction designated by the arrow R stopped at the position where the interlocking portion 19 abuts the stopper 26.

Figure 3:
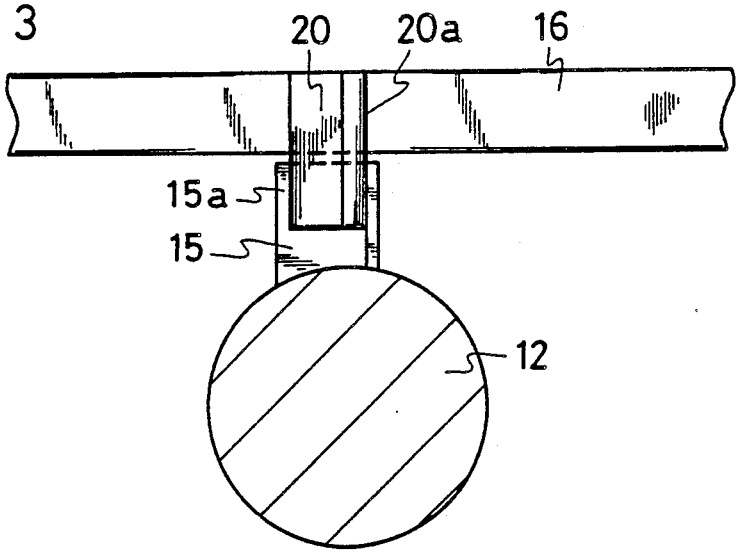
FIG. 3 is a section taken along line III—III of FIG. 1.

FIG. 3 is a cross section of the knob 11 taken along line III—III of FIG. 1. The first protuberance 15 radially outwardly extending is formed on the outer periphery of the stem portion 12 of the knob 11. As shown in FIG. 3, the second protuberance 20 of the driving lever 16 is disposed above the first protuberance 15, and a contact surface 15*a* of the first protuberance 15 and a contact surface 20*a* of the second protuberance 20 abut each other at the original position where the knob 11 is not rotated as shown in FIG. 1.

Figure 4:
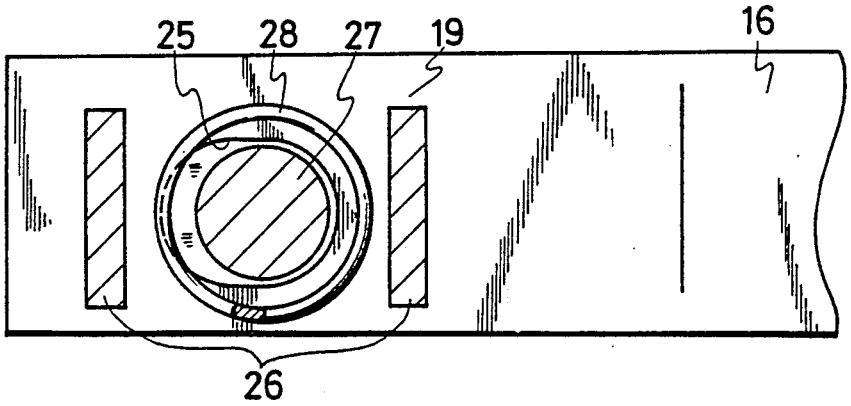
FIG. 4 is a section taken along line IV—IV of FIG. 1.

FIG. 4 is a cross section of the interlocking portion 19 of the driving lever 16 taken along line IV—IV of FIG. 1. The hole 25 formed in an elliptic shape having the major axis in the longitudinal direction of the driving lever 16, and the guide shaft 27 of the push button 29 extends through this hole 25. This allows the hole 25 to deviate relative to the guide shaft 27 in the direction of the major axis thereof as the driving lever 16 rotates angularly in the direction designated by the arrow R on the fulcrum 22.

Figure 5:
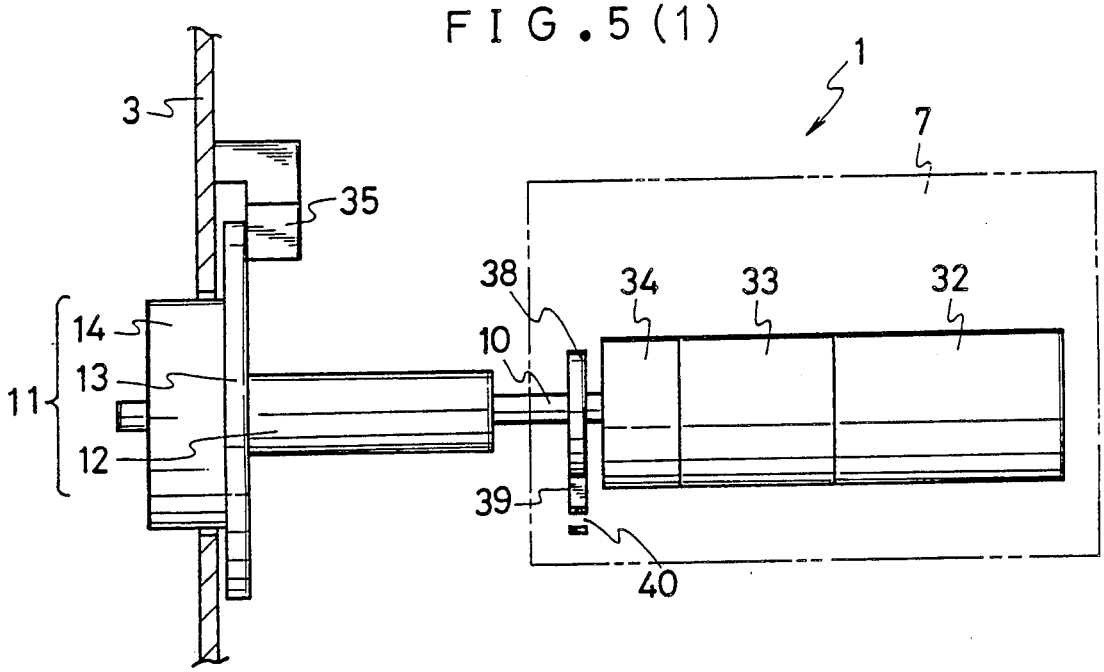
FIG. 5 (1) is a simplified side view of the embodiment.
Figure 5:
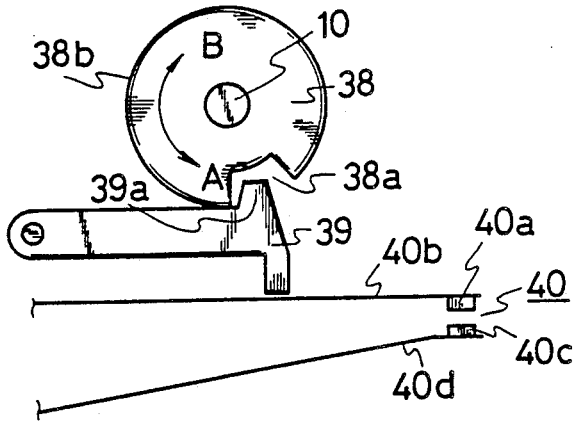
Figure 6:
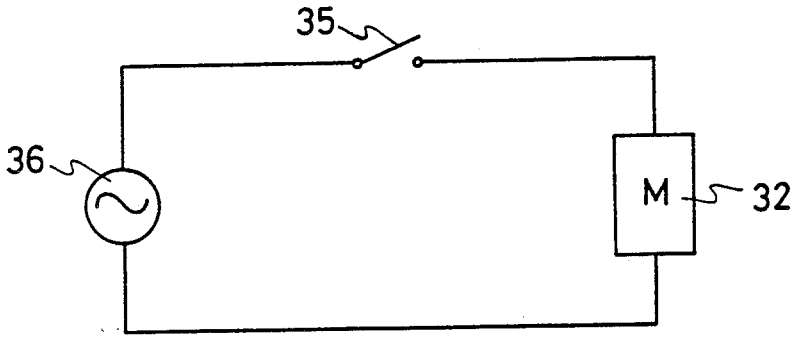
FIG. 6 is a circuit diagram for explaining supply of electricity to a motor.

FIG. 5 (1) is a simplified side view of the timer 1; FIG. 5 (2) is a view showing a mechanism of outputting an electrical signal in the timer body 7; FIG. 6 is a circuit diagram for explaining supply of electricity to a motor 32; FIG. 7 is a view showing the knob 11 in operation; and FIG. 8 is a waveform graph showing the electrical signal outputted from the timer body 7.

The timer body 7 is composed of the motor 32, a reduction gear train 33, a one-way clutch 34, a cam 38, a lever 39 and a pair of contacts 40. The power i.e., the rotating speed of the motor or the like is reduced by the reduction gear train 33, being further transmitted to the operating shaft 10 through the one-way clutch 34. When electricity is supplied to the motor 32 by a commercial AC power source 36, it rotates at a rotating speed corresponding to the frequency thereof. Change-over of the supply is performed by a switch 35. As shown in FIG. 5 (1), the cam 38 is mounted on the operating shaft 10 of the timer body 7. As shown in FIG. 5 (2), in the cam 38, a notch 38*a* is formed at the original position of the operating shaft 10, and when the timer body 7 is not operated, that is, when the operating shaft 10 is located at the original position, a convex portion 39*a* at the tip of the lever 39 is engaged with the notch 38*a*. A pair of contacts 40 is provided below the lever 39. At the cam 38 rotates, an electrode plate 40*b* whereon a contact 40*a* is provided is pressed down by the convex portion 39*a* of the lever 39 toward an electrode plate 40*d* whereon a contact 40*c* is provided. Namely, when the knob 11 is manipulated to rotate the cam 38 to a desired angular position in the direction designated by an arrow A in FIG. 5 (2), the convex portion 39*a* of the lever 39, disengages from the notch 38*a* of the cam 38, and moves to an outside surface 38*b* thereof. Thus, the lever 39 presses down the electrode plate 40*b*, and the contact 4*a* and the contact 40*c* touch each other. By the contact of a pair of contacts 40, the electrical signal starts to be outputted.

The switch 35 is provided in the vicinity of the flange 13 of the knob 11 fixed to the operating shaft 10, being interlocked with rotating operation of the knob 11. This means that the switch 35 is OFF at the original position of the knob 11, and for example, when the knob 11 is rotated by the operator to a desired angular position in FIG. 7 (1), the switch 35 is turned ON, and the motor 32 is actuated.

As described above, the one-way clutch 34 is located between the reduction gear train 33 and the operating shaft 10, and the rotary power in the direction reverse to the rotation manipulation direction is transmitted from the motor 32 to the operating shaft 10, but the rotary power in the rotation manipulation direction from the operating shaft 10 to the reduction gear train 33 is not transmitted.

Accordingly, when the knob 11 is rotated, the flange 13 turns on the switch 35, to actuate the motor 32, but during rotating manipulation of the knob 11, that is, the operating shaft 10, the power of the motor 32 is not transmitted to the operating shaft 10 due to disengagement of the one-way clutch 34. Then, when the rotating manipulation of the knob 11 is completed, the one-way clutch 34 transmits the power from the motor 32 to the operating shaft 10, and returns the knob 11 in the direction reverse to the rotation manipulating direction.

When the knob 11 returns to the original position, the flange 13 turns the switch 35 OFF, and the motor 32 is deenergized not to further rotate the knob 11. Also, in response to the above-mentioned change-over of ON/-OFF state of the switch 35, the timer body 7 outputs an electrical signal S1 (FIG. 8) continuing high level by contact of a pair of contacts 40 for a duration W1 corresponding to the amount of rotation in angle made by rotating manipulation of the knob 11 during which the operating shaft 10 returns in the direction reverse to the rotation manipulating direction. Based on this electrical signal S1, the microwave oven 2 performs heat cooking for a heating time determined by the duration W1.

FIG. 9 is a view for explaining operation related to the push button 29 of the timer 1. As shown in FIG. 1, in the state that the knob 11 is not manipulated, the push button 29 at an original position is being biased toward the front panel 3 side by the compression spring 28 through the interlocking portion 19 of the driving lever 16. Then, the flange 29*a* of the push button 29 abuts the inner surface of the front panel 3. Also, the knob 11 stops at the original position where the first protuberance 15 formed on the stem portion 12 abuts the second protuberance 20 of the driving lever 16.

In the case where counting time of the timer 1 is set by the push button 29, as shown in FIG. 9 (1), the press portion 29*b* is pressed in the direction designated by an arrow P1. Thus, the push button 29 rotates the driving lever 16 in the direction designated by an arrow R1 against the biasing force of the compression spring 28. Then, the interlocking portion 19 stops at the position designated in FIG. 9 (2) where it abuts the stopper 26.

At this time, the driving lever 16 to be rotated in angle in the direction designated by the arrow R1 moves nearly in the direction of the axial line of the stem portion 12 in the state that the contact surface 20*a* of the second protuberance 20 thereof abuts the contact surface 15*a* of the first protuberance 15 formed on the stem portion 12 of the knob 11. Therefore, a resisting force acts from the contact surface 20*a* of the second protuberance 20 to the contact surface 15*a* of the first protuberance 15, biasing the first protuberance 15 in the right direction in the FIG. 9 (1) or (2). Accordingly, the knob 11 is rotated by a predetermined angle around the axial line in the direction designated by an arrow R3 by the above-mentioned resisting force applied to the first protuberance 15, and the operation designated in FIG. 7 (2) is performed. That is, the operating shaft 10 is rotated by pressing the push button 29 without rotating manipulation of the knob 11, as shown in FIG. 7 (2), a short heating time, for example, one minute corresponding to the above-mentioned predetermined angle is set.

As shown in FIG. 9 (2) and FIG. 9 (3), when the push button 29 is pressed until the interlocking portion 19 of the driving lever 16 to contact the stopper 26 and thereafter the pressing push button thereof is released, the push button 29 is returned in the direction designated by an arrow P2 by the biassing force of the compression spring 28 applied through the interlocking portion 19. In response to this, the operating lever 16 also rotates in angle in the direction designated by an arrow R2 on the fulcrum 22 of the mounting portion 17, and is rendered in a state designated in FIG. 9 (3).

Therefore, the second protuberance 20 of the driving lever 16 is separated from the first protuberance 15 of the knob 11, and in accordance with the rotation of the operating shaft 10, the knob 11 is made possible to rotate in angle in the direction designated by an arrow R4. Thus, the operating shaft 10 of the timer body 7 returns in the direction designated by the arrow R4 for a duration corresponding to the above-mentioned rotation by a predetermined angle, and the first protuberance 15 abuts the second protuberance 20 again. The operating shaft 10 stops at a timing when the switch 35 explained in relation to FIG. 5 is turned OFF by the flange 13 of the knob 11.

At this time, the timer body 7 outputs an electrical signal S2 whose high level is continued by contact of a pair of contacts 40 for a constant period of time W2 corresponding to the above-mentioned predetermined angle designated in FIG. 8 (2) during which the operating shaft 10 returns in the reverse direction by a rotated predetermined angle. Based on this electrical signal S2, the microwave oven 2 performs heat cooking for the constant Period of time W2.

As described above, in this embodiment, a straight line movement in position of the push button 29 in the direction designated by the arrow P1 is converted into a rotation of the knob 11 in angle in the direction designated by the arrow R3 by the driving lever 16. Therefore, only by pressing the push button 29, the timer 1 can drive the operating shaft 10 of the timer body 7 to make a rotation by a predetermined angle in the operating direction. Accordingly, time setting of the period of time corresponding to the above-mentioned predetermined angle can be performed without troublesome rotating manipulation of the knob 11 at every setting, and the operation ability is improved.

As described above, in accordance with the present invention, only by pressing the push button provided in the timer, counting operation of a predetermined duration can be simply performed. Further, manipulation of the timer can be improved. Also, the push button and the driving means for driving the operating shaft of the timer body to make rotation in angle in cooperation therewith of the present invention can be realized by a comparatively simple configuration, and the manufacturing cost can be reduced to a great extent.

What is claimed is:

1. A timer comprising:

a timer body which has an operating shaft capable of angularly rotating around an axis thereof from an original position, and outputs a continuous electrical signal only for a period of time during which the operating shaft returns from a desired angular position to the original position after the operating shaft has been rotated from the original position to the desired angular position, a knob provided at one end of the operating shaft, a push button capable of being pressed to a predetermined distance, and driving means for rotating the operating shaft from the original position by an angle corresponding to a distance to which the push button is pressed.

2. A timer in accordance with claim 1, wherein the timer body comprises a rotation driving means for rotating the operating shaft from a desired angular position to the original position, a cam provided on the operating shaft, a lever moved by rotation of the cam, and a pair of contacts controlled by movement of the lever.

3. A timer in accordance with claim 2, wherein the rotation driving means comprises a motor, a reduction gear train connected to a rotary shaft of the motor which reduces the rotating speed of the motor, and a one-way clutch interconnecting is interconnecting the reduction gear train and the operating shaft which rotates the operating shaft only in one direction corresponding to rotation of the motor.

4. A timer in accordance with claim 1, wherein the knob has a stem portion on outer periphery thereof on which a first protuberance is provided, said stem portion being connected to the operating shaft, and the driving means comprises a driving lever which has a second protuberance coming in contact with the first protuberance when the operating shaft is located at the original position and moves the second protuberance in the axial direction of the operating shaft corresponding to the distance to which the push button is pressed, whereby the first protuberance moves around the axis of the operation shaft by an angle corresponding to the distance to which the push button is pressed from an original position of the push button.

5. A timer in accordance with claim 1, which is used for a microwave oven.

* * * * *